US006075867A

United States Patent [19]

Bay et al.

[11] Patent Number: 6,075,867

[45] Date of Patent: Jun. 13, 2000

[54] MICROMECHANICAL MICROPHONE

[75] Inventors: Jesper Bay, Charlottenlund; Siebe Bouwstra, Hillerød; Ole Hansen, Hørsholm, all of Denmark

[73] Assignee: Microtronic A/S, Roskilde, Denmark

[21] Appl. No.: 08/981,714

[22] PCT Filed: Jun. 21, 1996

[86] PCT No.: PCT/DK96/00276

§ 371 Date: Mar. 19, 1998

§ 102(e) Date: Mar. 19, 1998

[87] PCT Pub. No.: WO97/01258

PCT Pub. Date: Jan. 9, 1997

[30] Foreign Application Priority Data

Jun. 23, 1995 [DK] Denmark ..... 726/95

[51] Int. Cl.[7] ..... H04R 25/00

[52] U.S. Cl. ..... 381/191; 381/398; 181/171

[58] Field of Search ..... 381/191, 26, 56, 381/64, 95, 184, 398, 124, 113, 174, 175, 116; 181/148, 150, 154, 157, 158, 172; 310/322, 324, 326, 334; 29/25.41; 367/181, 178, 188, 167

[56] References Cited

U.S. PATENT DOCUMENTS 3,980,838 9/1976 Yakushiji et al. .
4,232,205 11/1980 Ribeyre ..... 179/146 R

FOREIGN PATENT DOCUMENTS 0118356 2/1984 European Pat. Off. .
9515067 11/1994 WIPO .

*Primary Examiner*—Curtis A. Kuntz
*Assistant Examiner*—Suhan Ni
*Attorney, Agent, or Firm*—Watson Cole Grindle Watson, P.L.L.C.

[57] ABSTRACT

A Micromechanical Microphone is formed with a housing and a transducer therein. The housing has a sound inlet on one side of the transducer and a pressure compensation hole on the opposite side. A sealing diaphragm is placed on each side of the transducer to seal it against humidity, dust and dirt. The transducer may be a capacitive transducer with an external bias or an electret based transducer. The microphone is useful in small devices such as hearing aides.

16 Claims, 1 Drawing Sheet

MICROMECHANICAL MICROPHONE

The present invention concerns a micromechanical microphone with a housing in which a transducer element is placed, and which has a sound inlet on one side of the transducer element and a pressure compensation hole on the other side. Primarily the pressure compensation hole has a high acoustic impedance at audio frequencies, and is placed in a, in other respects, closed rear chamber.

The transducer element normally consists of a membrane which deflects due to the sound pressure, and an arrangement to convert this deflection into an electrical signal.

Commonly known microphones of small dimensions, as of the magnitude 3.5 mm×3.5×2 mm, for example for use in hearing aids, are traditionally manufactured by assembling a number of individual parts, such as plastic foils, metal parts, hybrid pre-amplifiers etc., in total 12–15 parts.

In the past, many different prototype microphones have been fabricated using micromechanics which is a technology based on advanced silicon integrated circuit manufacturing concepts but used for the fabrication of mechanical components. The advantage of this technology is that microphones with improved characteristics can be obtained and it is possible to realise batch fabrication where hundreds of thousands of devices are processed at the same time implying that production cost can be reduced significantly.

Up till now the micromechanical microphones have not been able to fulfil the demands for use in hearing aids, especially because they have been far too sensitive to humidity, dust and dirt which partly or totally has been able to damage the performance of the microphone. Of prior art within the area, which can be used to overcome some of the above mentioned disadvantages, is disclosed in U.S. Pat. No. 2,086,107 which describe a condenser microphone of conventional (i.e. not micromechanical) design, where the transducer element on the sound inlet side is sealed by the microphone membrane itself, and where the back side is closed by a rubber membrane which can expand and contract by changes in the barometric pressure as a chamber on the outer side of the rubber membrane is connected with the environment via a pressure compensation hole.

This technical solution gives a sealing which is adequate for traditional microphones as the condenser microphone referred to above, but it has a number of disadvantages when used in small micromechanical microphones. This is because the membranes exhibit very large static deflections when the atmospheric pressure and/or the temperature changes.

The membranes centre deflection is for example more than twice as large as the height of the encapsulated volume multiplied by the relative pressure change and even bigger if the area of the membrane is smaller than the rear chambers sectional area. Static pressure variations of ±10% are not unrealistic, meaning that the membrane's static deflection can be in the range of 0,5 mm at a height of 2 mm. In a micromechanicel microphone this is unacceptable. Firstly, deflections of this magnitude consumes far too much space, meaning that the microphone gets significant bigger than necessary and desirable. Secondly, it requires a very soft membrane material to keep the membrane acoustical transparent under such large static deflections. It may not be impossible to find a material that meets these requirements, but if it should be compatible with a micromechanical production process, it limits the possibilities drastically, meaning a far more complicated production process is needed.

One solution would be to make the sealed membranes of a material with microscopic pores allowing a pressure compensation as described in U.S. Pat. No. 5,222,050 and WO 95/21512. It could e.g. be a porous PTFE-film ("Teflon"), which among others is sold under the trade name "GORE-TEX". This material does not allow water and dust particles bigger than the pores in the material to pass, while gasses diffuses freely through. This solution, however, is not appropriate as the pores will clog-up, and further, the material is difficult to combine with micromechanical production processes.

The purpose of the present invention is to solve the above discussed problems and, according to the invention, this is obtained by the presence of a sealing acoustic transparent membrane on each side of the transducer element in a distance in the range of 50 μm or less from this.

The invention makes use of the gas law, saying, that pressure p multiplied by the volume V divided with the absolute temperature T is constant $$\frac{p * V}{T} = \text{constant} \tag{1}$$

As the membranes have to be acoustically transparent only a inconsiderable difference in pressure acting on them is necessary to make them deflect. The pressure in the sealed volume may therefore be considered equivalent to the atmospheric pressure outside. This means that if the temperature and/or the static pressure (the atmospheric pressure) is changing, the encapsulated volume must change proportionally, to satisfy expression (1). The relative change of the encapsulated volume will be:

$$\frac{\Delta V}{Vo} \approx \frac{\Delta T}{To} - \frac{\Delta p}{po} \tag{2}$$

where initial pressure, -temperature and -volume are notified by index 0, and the increase is notified with Δ.

If the encapsulated volume V is the whole rear chamber, as it is the case in the above mentioned U.S. Pat. No. 2,086,107, the absolute change in volume ΔV and thereby the membrane deflection must be very large. However, when the sealed membranes, according to the invention, are placed close to the transducer element the encapsulated volume gets smaller and therefore requires a smaller absolute volume change and thereby a small membrane deflection. If e.g. maximum deflections in the size of 50 μm are allowed at a pressure change of 50,000 Pa, the distance between the transducer element and the sealed membranes must be max. 50 μm, as the air volume in the transducer element is considered negligible.

A large deflection will stretch the membrane, which makes it stiffer. When the deflections are small there will therefore be less demands to the membrane material, and hereby it gets easier to provide a material which features an acoustic transparent membrane. When the membranes are small they only take up a minor part of space and in so the microphone can be produced with smaller dimensions.

If the encapsulation of the sensitive transducer element is hermetic, humidity and dust will be kept totally out in the same way as with the above mentioned traditional condenser microphone. However, if the sealed membranes are diffusion transparent for water vapour, the total amount of vapour which can condense, will anyway be very small due to the small encapsulated volume, and the amount of vapour which can condense is therefore insignificant. At the same time, slow variations in the static pressure will be compensated.

The initial pressure and the gas in the chamber between the sealed membranes can be controlled according to the invention, which advantageously can be obtained by use of micromechanics in the production process The gas must, of course, contain an absolute minimum of water vapour.

The suggested microphone is not limited to an exact type of transducer element and can as such e.g. be a capacitive transducer element with external bias, an electret based transducer element or a tunnel current based transducer element of which all typically would have a membrane as a part of the transducer element.

Through a special embodiment of the microphone according to the invention, the two sealed membranes are mechanically connected and electrically conductive or provided with an electrically conductive layer. The transducer element is in this embodiment provided with a fixed conductive electrode, which together with the two sealed membranes, directly makes a capacitive microphone. The mechanical connection between the membranes serves in reducing the effects of changes in the static pressure on the microphones sensitivity for the sound pressure.

The connection between the membranes constitutes, according to the invention, appropriately of piles which can be wider than they are high and which passes freely through the holes in the fixed electrode between the membranes. Although, such a construction appears complicated, it is possible to realise it by means of micromechanics.

In a further embodiment of the microphone the peripheral areas of the sealed membranes have no mechanical interconnection by means of piles. These peripheral regions are hereby able to absorb the static pressure variations by means of deflection, so that the sealed volume and therewith the pressure in it, changes. The deflection of the central area of the membranes gets very small due to the piles. In a further embodiment only the central areas of the sealed membranes are electrically conductive. By means of this, the deflection of the peripheral areas affects the microphone's sensitivity for sound pressure significantly less because the signal comes only from the electrodes on the central areas which is not deflected much by static pressure due to the piles and the pressure compensation, as the deflection of the peripheral areas gives.

By another embodiment according to the invention, the conductive central areas of the sealed membranes are thicker and stiffer than the peripheral regions. This adds further to making the microphone's sensitivity independent of the static pressure.

By an embodiment of the invention, the fixed electrode may have cut-outs in the peripheral areas. The membrane may be electrically conducting all over, but the signal comes only from the central region where the fixed centre electrode is.

According to a further aspect of the invention, the transducer element can include a membrane and two fixed conductive back plates with through holes, placed on each side of the membrane. This construction features significant sensitivity for the sound pressure, meaning that in spite of the small size, a significant electrical signal may be achieved. It may be convenient to provide the membrane with a small hole for pressure compensation as it would make a strictly symmetric construction unnecessary. The hole must be so small that it has a high acoustic impedance in the audio frequency range.

A further improvement of the microphones characteristics can be achieved according to the invention, when a so called "force-balancing"—feedback circuit counteracts the deflection of the transducer element's membrane(s), typically by means of electrostatic forces. By capacitive transducer elements a higher sensitivity is obtained, as it is possible to work with a higher bias voltage, without the membrane will be dragged in to one of the back plates. This also counts for, among others, the transducer element with two membranes, which at the same time forms the sealing with a fixed electrode in between and for the transducer element consisting of a membrane and two back plates. The force-balancing can, as a matter of fact, also by most types of transducer elements imply other advantages, such as an increased bandwidth and better linearity of the microphone, and a reduced sensitivity to variations in the membrane's and the rear chamber's stiffness.

The invention may hereafter be further explained accordingly to the drawing, where:

Figure 3:
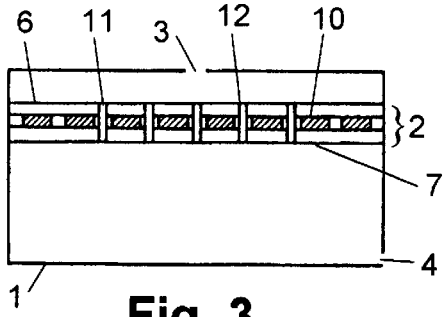
FIG. 3 shows another embodiment with a fixed electrode between the two membranes, which is connected by means of piles, shown without influence of pressure.
Figure 4:
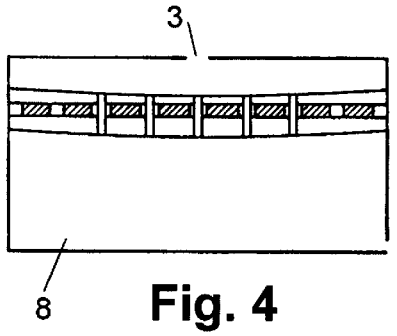
Figure 5:
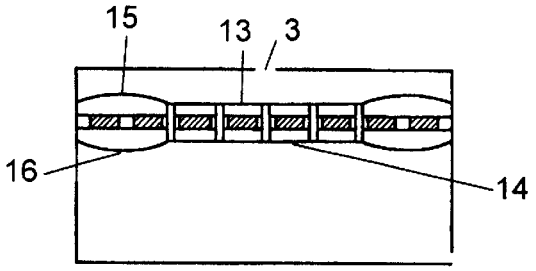
Figure 6:
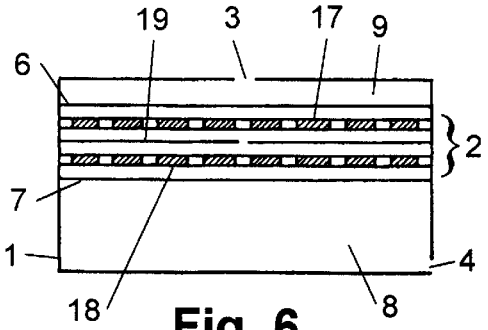
Figure 7:
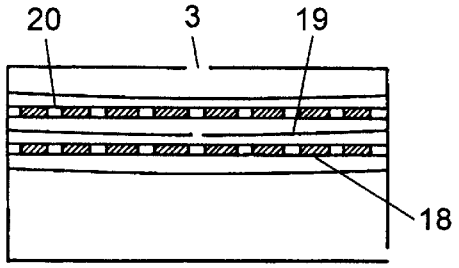
Figure 8:
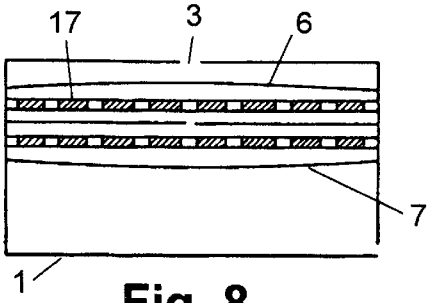
Figure 9:
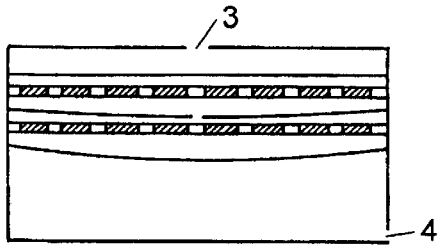

FIG. 4 the same as above under influence of pressure,

FIG. 5 the same as FIGS. 3 and 4, but under influence of a static pressure, FIG. 6 a further embodiment for a microphone according to the invention, where the transducer element consists of two back plates and a membrane in between, shown without pressure influence, FIG. 7 the same as FIG. 6, but under influence of sound pressure, FIG. 8 the same as FIG. 6, but under influence of static pressure, FIG. 9 the same as FIG. 6, but under influence of both a sound pressure and a static pressure.

Figure 1:
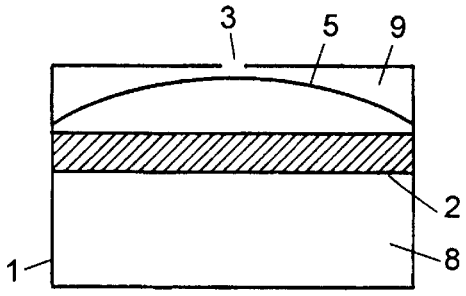
FIG. 1 shows a microphone with a single, sealed membrane and a sealed rear chamber where a static pressure change of approximately 20% has occurred after the end of the sealing process.

The microphone shown in FIG. 1 has a housing 1, in which a transducer element 2 is placed, and which has a sound inlet 3. Above the transducer element 2, there is a front chamber 9 in which a sealing membrane 5 is placed, which primarily is acoustic transparent, with a compliance that does not influence the sound pressure. Below the transducer element 2 there is a hermetic closed rear chamber 8. The microphone is shown at a static pressure change at 20%, which has caused the membrane deflect strongly, so the volume change of the hermetic sealed chamber mostly neutralises the change in the static pressure, as the pressure in the sealed chamber falls when the volume increases. It is clear that this construction requires a front chamber of significant size in order to allow room for the large deflection of the membrane.

Figure 2:
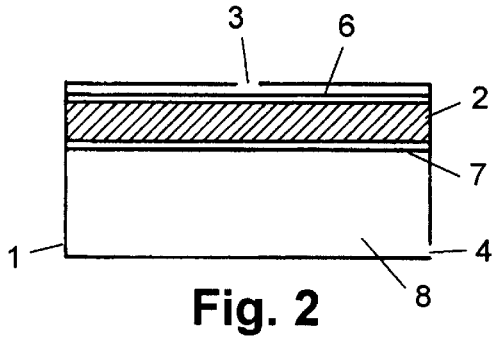
FIG. 2 shows an embodiment for a microphone according to the invention with two sealed membranes and a ventilation hole in the rear chamber.

In the embodiment for a microphone according to the invention shown in FIG. 2, the rear chamber 8 is provided with an air ventilation hole or pressure compensation hole 4, and above the transducer element 2 a sealing acoustic transparent membrane 6 is placed, and under the transducer element a similar sealing and acoustic transparent membrane 7 is placed. The membranes 6 and 7 are placed closely to the transducer element, by which means the encapsulated volume between the membranes is getting much smaller than if the whole rear chamber 8 is included in the sealed volume. The necessary deflections of the membranes are thereby also getting proportionally smaller. In this context it should be mentioned, that large deflections will stretch the membranes which makes them stiffer and this, again, causes that the membranes are getting less acoustic transparent. With the construction shown in FIG. 2 this disadvantage is strongly reduced or even totally avoided.

In the embodiment shown in FIGS. 3, 4 and 5 the transducer element 2 consists of a fixed conductive electrode 10 and two sealed membranes 6 and 7, which are (connected with each other by means of connection piles 11, which passes through the holes 12 in the electrode 10. The sealed membranes 6 and 7 are in their central area 13 and 14 electrically conductive, as they as an example are provided with electrically conductive coatings by which means the membranes together with the electrode 10 forms a capacitive microphone where the rear chamber 8 which like in the embodiment in FIG. 2 is provided with a pressure compensation hole 4. The mechanical connection, which is established by means of the piles 11, the holes are not touching the centre electrode 10 in the holes 12, serves to reduce the influence of static pressure changes on the microphones sensitivity for the outside coming sound pressure.

In FIG. 3 the microphone is shown without influence from any pressures. A sound pressure through the opening 3 will deflect both membranes 6 and 7 in same direction, as shown in FIG. 4. This effect will appear regardless of whether the membranes 6 and 7 are connected with the piles 11 or not. The deflection changes the electrical capacitances between the two membranes and the centre electrode 10 as one increases and the other reduces.

In FIG. 5 the case where the static pressure has dropped is shown. The peripheral areas 15 and 16 of the membranes which are not connected with piles, absorbs the static pressure variations by deflecting, so the sealed volume and consequently the pressure therein, is changing. The deflection of the central area of the membranes is very small due to the piles 11. Furthermore, if the membranes are thicker in the central area 13 and 14 than in the peripheral regions, the deflection arising from the static pressure is further reduced. The deflection of the peripheral areas 15 and 16 does not influence significantly on the sound pressure measurement, as it is realised by means of the electrodes on the central area. In a further embodiment (not shown) of this construction, the central fixed electrode has cut-outs in the peripheral areas where the electrode has no electrical function. This can be used for defining the condenser area, if the membranes are conductive all over, and the area is not definable by means of electrodes on the membranes. Furthermore it can be used in order to obtain a lower damping and a higher sensitivity.

In the embodiment for a microphone shown in FIGS. 6, 7, 8 and 9, according to the invention the same cross-reference symbols for the same parts are used as in the previous figures. In a housing 1 a transducer element 2 is placed and the housing has a sound inlet 3 and a pressure compensation hole 4 and sealed acoustic transparent membranes 6 and 7 are placed in a front chamber 9 and a rear chamber 8 respectively. In order to obtain a high sensitivity, the transducer element is provided with two back plates 17 and 18 placed one on each side of a membrane 19, which is deflected by the sound pressure. By using two back plates for capacitive detection a doubled sensitivity is obtained compared to the case of only using one back plate. As the two electrostatic forces, by the embodiment with two back plates, influences the membrane from both sides, it gets possible to use a higher evaluation voltage without having, the membrane dragged in to the back plate. This gives a farther increase in sensitivity Also for this type of microphone cut-outs in the back plates or electrodes on a non-conductive membrane can be used. This can give an increased sensitivity and/or a lower damping.

In FIG. 6 this microphone embodiment is shown without any pressures acting, while FIG. 7 shows the microphone being exposed for a sound pressure through the sound inlet 3. FIG. 8 shows the microphone being exposed for a static pressure, according to the embodiment shown in FIG. 5 and FIG. 9 shows the microphone as it, at the same time, is exposed for a sound pressure and a static pressure.

The transducer element referred to above shown in FIGS. 2–5 with a conductive centre electrode 10 and two membranes 6 and 7, one on each side of 10 and the transducer element shown in FIGS. 6–9 with a membrane 19 and two back plates 17 and 18, in a simply way, makes it possible to realise a feedback loop which enables "force-balancing" by which the membrane or the membranes are under influence of electronically controlled forces, which ideally counterbalances the acoustic pressure on it/them, so that it/they are kept in it's/their equilibrium position. This reduces the sensitivity for variations in stiffness of the rear chamber 8, which is depending on the static pressure, and in the stiffness of the membrane/membranes. For example by the microphone embodiment in FIGS. 6–9 with a back plate 17, 18 on each side of the membrane 19 there can, for example, by applying an electrical voltage on the membrane relative to the back plates, be created an electrostatic force on it, which is proportional to the voltage. If there is only one back plate and one membrane the pressure will be proportional to the square of the voltage, which makes the feedback circuit more complicated. At the same time a static deflection of the membrane occurs. Furthermore, the "force-balancing" can generally give an increased bandwidth and a better linearity.

The force-balancing feedback circuit can be built as a $\Sigma\Delta$-converter The microphone may in that case be a part of the converter, as it may perform two integrations. These can be realised by the microphone's second order slope observed at frequencies higher than the resonance frequency, where the microphone roughly acts as a double integrator.

The miniature sized microphones described in this context for use in hearing aids, operate at battery voltages in the order of 1 V. In order to realise electrostatic feedback for "force-balancing" and/or to achieve good sensitivity of microphones with a capacitive transducer element at this low level operating voltage, a very small air gap distance (below 1 $\mu$m), between the transducer elements membrane (s) 6 and 7 accordingly 19 and back plate(s) 10 accordingly 17 and 18 is required. For example the air gap should be about max. 0,5 $\mu$m, to make it possible to counterbalance a sound pressure of 10 Pa by means of a voltage of 1 V. Air gaps that small are today only possible to realise by means of micromechanics. When the air gap is that small it is necessary to provide the back plates with a very big amount of air holes 12 respectively 20 in order to avoid that the air flow in the air gap presents a too big acoustic resistance. The distance between the holes may be less than 10 $\mu$m, which is feasible by means of micromechanics, but difficult with traditional technology. This means, it is necessary to have very small air gaps and holes, which, however, makes the microphones sensitive for dust and humidity and therefore, necessitates sealing.

What is claimed is:

1. A micromechanical microphone with a transducer element having a conductive center electrode formed with through holes within its periphery and spaced therefrom, an electrically conductive sealing diaphragm disposed on each side of the center electrode, the diaphragms being fixed to the center electrode along the periphery thereof, the microphone comprising:

connecting means mechanically interconnecting the diaphragms, said connecting means passing movably through at least one of the holes in the center electrode for allowing the diaphragms and the connecting means to move relative to the center electrode.

2. A microphone according to claim 1, further including a housing, the transducer element being accommodated in the housing so that the transducer element defines a rear volume in the housing with one of the diaphragms facing the rear volume, the housing having a sound inlet giving access of sound to the other of the diaphragms and a pressure compensation opening giving access of air to the rear volume for equalizing changes in static pressure.

3. A microphone according to claim 1, wherein the diaphragms comprise electrically conductive central areas.

4. A microphone according to claim 1, wherein the membranes have central and peripheral regions and the central regions of the diaphragms are stiffer than the peripheral regions.

5. A microphone according to claim 4, wherein the peripheral regions have cut-out openings and a fixed electrode is located within the cut-outs.

6. The microphone of claim 1, wherein the diaphragms are spaced relative to the transducer element at distances in the range of up to about 50 $\mu$m.

7. A microphone according to claim 6, wherein the distance is in the range of up to about 1 $\mu$m.

8. A microphone according to claim 1, having a predefined gas pressure in a chamber defined between the sealed diaphragms.

9. A microphone according to claim 1, wherein the sealing diaphragms have electrically conductive portions.

10. The microphone of claim 1, wherein the electrically conductive portions comprise a conductive coating covering a portion of said diaphragms.

11. A Microphone according to claim 1, wherein the connecting means comprises piles passing through holes in the center electrode.

12. A microphone according to claim 11, wherein only central regions of the diaphragms are interconnected by the connecting means.

13. A microphone according to claim 1, wherein only central regions of the diaphragms are electrically conductive.

14. A microphone according to claim 1, wherein the transducer element comprises a pressure sensitive electrically conductive diaphragm and two electrically conductive fixed backing plates with through going holes placed on opposite sides of the diaphragm.

15. A microphone according to claim 14, wherein the fixed back plates have cut-outs.

16. A micromechanical microphone with a transducer element having a conductive center electrode formed with through holes within its periphery and spaced therefrom, an electrically conductive sealing diaphragm disposed on each side of the center electrode, the diaphragms being fixed to the center electrode along the periphery thereof, the microphone comprising:

connecting means mechanically interconnecting the diaphragms, said connecting means passing movably through at least one of the holes in the center electrode for allowing the diaphragms and the connecting means to move relative to the center electrode, and wherein the diaphragms have central and peripheral regions and the central regions of the diaphragms are stiffer than the peripheral regions.

* * * * *